US011578283B2

(12) United States Patent
Smith

(10) Patent No.: US 11,578,283 B2
(45) Date of Patent: Feb. 14, 2023

(54) FUEL ECONOMY

(71) Applicant: SHELL OIL COMPANY, Houston, TX (US)

(72) Inventor: Alastair Graham Smith, London (GB)

(73) Assignee: SHELL USA, INC., Houston, TX (US)

( * ) Notice: Subject to any disclaimer, the term of this patent is extended or adjusted under 35 U.S.C. 154(b) by 0 days.

(21) Appl. No.: 17/414,618

(22) PCT Filed: Jan. 27, 2020

(86) PCT No.: PCT/EP2020/051952
§ 371 (c)(1),
(2) Date: Jun. 16, 2021

(87) PCT Pub. No.: WO2020/157017
PCT Pub. Date: Aug. 6, 2020

(65) Prior Publication Data

US 2022/0056359 A1 Feb. 24, 2022

(30) Foreign Application Priority Data

Jan. 29, 2019 (EP) ..... 19154165

(51) Int. Cl.
*C10L 1/16* (2006.01)

(52) U.S. Cl.
CPC ..... *C10L 1/1658* (2013.01); *C10L 2200/0446* (2013.01); *C10L 2230/22* (2013.01);
(Continued)

(58) Field of Classification Search
CPC ..... C10L 1/1658; C10L 2200/0446; C10L 2230/22; C10L 2250/04; C10L 2270/026; C10L 2290/24
See application file for complete search history.

(56) References Cited

U.S. PATENT DOCUMENTS 3,775,329 A 11/1973 Eckert
4,358,565 A 11/1982 Eckert
(Continued)

FOREIGN PATENT DOCUMENTS

GB 1487823 A 10/1977
JP H1031507 A 2/1998
(Continued)

OTHER PUBLICATIONS

International Search Report and Written Opinion received for PCT Patent Application No. PCT/EP2020/051952, dated Mar. 25, 2020, 09 pages.
(Continued)

*Primary Examiner* — Ellen M Mcavoy
(74) *Attorney, Agent, or Firm* — Shell USA, Inc.

(57) ABSTRACT

Use of a viscosity increasing component in a diesel fuel composition, for the purpose of improving the fuel economy of an engine into which the fuel composition is or is intended to be introduced, or of a vehicle powered by such an engine, wherein the viscosity increasing component is a viscosity index (VI) improving additive, wherein the VI improving additive comprises a linear block copolymer, which contains one or more monomer blocks selected from ethylene, propylene, butylene, butadiene, isoprene and styrene monomers and wherein the VI improving additive is used at a concentration of from 0.001% w/w to 0.05% w/w.

11 Claims, 2 Drawing Sheets

(52) U.S. Cl.
CPC ..... *C10L 2250/04* (2013.01); *C10L 2270/026* (2013.01); *C10L 2290/24* (2013.01)

(56) References Cited

U.S. PATENT DOCUMENTS

| | | | | |
|---|---|---|---|---|
| 4,427,834 | A | 1/1984 | Martin | |
| 4,490,267 | A | 12/1984 | Eckert | |
| 5,302,667 | A | 4/1994 | Rhodes et al. | |
| 5,906,665 | A | 5/1999 | Trippe et al. | |
| 2006/0254131 | A1 | 11/2006 | Waters et al. | |
| 2009/0241882 | A1* | 10/2009 | Brunner | C10L 1/1633 44/459 |
| 2012/0186143 | A1* | 7/2012 | Eggenstein | C10L 10/00 44/388 |
| 2020/0325410 | A1* | 10/2020 | Brewer | C10L 10/04 |

FOREIGN PATENT DOCUMENTS

| | | | |
|---|---|---|---|
| WO | 2012076652 | A1 | 6/2012 |
| WO | 2012076653 | A1 | 6/2012 |
| WO | 2013135912 | A1 | 9/2013 |

OTHER PUBLICATIONS

International Search Report and Written Opinion received for PCT Patent Application No. PCT/EP2011/072205, dated Feb. 14, 2012, 08 pages.
Hirschfelder et al., "Molecular Theory of Gases and Liquids", First Edition, 12 pages.
Office Action Received for Chinese Application No. 202080010870.0, dated Jun. 2, 2022, 13 Pages(7 Pages of English Translation and 6 Pages of Official Copy).

* cited by examiner

FUEL ECONOMY

CROSS REFERENCE TO RELATED APPLICATIONS

This is a National stage application of International application No. PCT/EP2020/051952, filed 27 Jan. 2020, which claims priority of European application No. 19154165.5, filed 29 Jan. 2019, which is incorporated herein by reference in its entirety.

FIELD OF THE INVENTION

The present invention relates to a method of improving diesel fuel economy in a compression-ignition (diesel) engine; and in particular to the use of viscosity increasing components in a diesel fuel composition to give improvements in fuel economy.

BACKGROUND OF THE INVENTION

Current emissions legislation in, for example, the US and Europe, sets strict limits on the acceptable levels of polluting gases that are tolerated in the exhaust gas emissions of compression ignition engines.

The typical approach taken by engine and fuel manufacturers to improving the combustion process and reducing the production of undesirable exhaust gas emissions is to utilise some form of "advanced combustion". Advanced combustion is an umbrella term that encompasses a number of different combustion modes, which typically involve one or more of the following features: fuel injection much advanced of Top Dead Centre (TDC); multiple fuel injections; high amounts of Exhaust Gas Recirculation (EGR); and high injection pressures. All of these modes generally attempt to achieve very low levels of NOx and soot (particulate matter) emissions through improved fuel-air mixing and reduced combustion temperatures.

Many engines also include some form of after-treatment to reduce exhaust gas emissions to the level required by emissions regulations. Typical after-treatments include devices such as catalytic converters (e.g. for removing NOx emissions) and/or particulate filters (e.g. to remove soot from the exhaust gas stream).

Present means of controlling advanced combustion processes in an engine are based on monitoring various engine/combustion parameters, such as NOx production, and using an engine control unit to make adjustments to engine parameters to push the engine towards a set of conditions under which it is perceived that NOx production during the combustion process will be minimised. However, a problem with adjusting such a sensitive process as advanced combustion, especially when it is pushed in the direction of minimal NOx production levels—under which conditions combustion can become unstable—is that incomplete combustion can occur, resulting in increased production of soot/particulate matter (PM). Exhaust gas emissions from diesel engines can, therefore, be seen as a trade-off between NOx and PM emissions.

Thus, in modern diesel vehicles the engine is generally set-up to produce low NOx emissions and consequentially high PM emissions; and a PM trap is employed to subsequently remove PM from the emissions in order to meet the low overall emissions criteria. It is known in the literature that this set-up results in lower engine efficiency and significantly increased fuel consumption. However, alternative emission reduction strategies are much more complicated and costly and have only been implemented on a large scale in heavy-duty vehicles. In fact, even were NOx after-treatments widely available for e.g. passenger cars, the reliability of PM filters would likely ensure that the engine set-up remains much the same for the foreseeable future.

However, it should be appreciated that the control of advanced combustion and exhaust gas emissions is not merely a matter of air charge and engine controls, but also of fuel properties, such as cetane number, density, and presence of particular additives etc. Accordingly, during development, an engine's emissions are measured by reference to a tightly specified reference fuel, and engine set-up is, therefore, optimised to the properties of that reference fuel. A downside of this system is that any changes in the type of fuel that is used in an engine can have a significant impact on both engine performance (e.g. reduced efficiency) and emissions.

For example, to facilitate modern vehicle after-treatment technologies and to reduce vehicle emissions still further, fuel refineries have invested in supplementary systems such as sulphur reducing technologies. This has generally resulted in the availability of lower density diesel fuels. The increased flexibility offered by these technologies has also enabled refineries to optimise "energy give-away" by further reducing fuel density nearer to the lower limit of the relevant full specification. The density of fuels in the market place has, therefore, gradually moved away from the reference fuels used for engine calibration. This shift in the properties of some fuels means that the type of fuel that is actually used in a particular engine can have a significant impact.

In addition, since the amount of fuel injected into the engine of a vehicle is largely controlled by volume, the reduction in density of fuels has lead to a reduced amount of combustible fuel in the engine cylinder and a consequential reduction in the effective amount of energy that can be converted. This drives the emissions of the engine further in the direction of low NOx and high PM, but to the detriment of engine efficiency and increased fuel consumption. Even though there may be a small benefit in NOx emission, it has now been appreciated that this set-up does not provide the optimum balance between fuel economy and exhaust emissions that would be intended by a vehicle manufacturer.

In view of the above operating procedures and problems, it is difficult to approach the optimum balance between fuel economy and exhaust gas emissions simply using standard refinery fuels. Accordingly, there is a need for improved fuels and methods for improving the fuel economy of engines.

WO2012/076653 discloses the use of a viscosity increasing component in a diesel fuel composition, for the purpose of improving the fuel economy of an engine into which the fuel composition is or is intended to be introduced. There are examples in WO2012/076653 disclosing the use of SV200 in a diesel fuel composition for improving fuel economy. SV200 is a polystyrene/polyisoprene stellate polymer. In the examples the SV200 is used at concentrations of 1000 ppm and 2000 ppm. It would be desirable to find a viscosity increasing component which can be used at a lower concentration but which can still provide significant fuel economy benefits.

This invention aims to overcome or alleviate at least one of the problems associated with the prior art.

SUMMARY OF THE INVENTION

Accordingly, in a first aspect of the invention, there is provided the use of a viscosity increasing component in a diesel fuel composition, for the purpose of improving the fuel economy of an engine into which the fuel composition is or is intended to be introduced, or of a vehicle powered by such an engine, wherein the viscosity increasing component is a viscosity index (VI) improving additive, wherein the VI improving additive comprises a linear block copolymer, which contains one or more monomer blocks selected from ethylene, propylene, butylene, butadiene, isoprene and styrene monomers and wherein the VI improving additive is used at a concentration of from 0.001% w/w to 0.05% w/w.

According to the present invention there is further provided a method for improving the fuel economy of an engine or of a vehicle powered by such an engine, the method comprising introducing into a combustion chamber of the engine a (diesel) fuel composition comprising a viscosity increasing component, wherein the viscosity increasing component is a viscosity index (VI) improving additive, wherein the VI improving additive comprises a linear block copolymer, which contains one or more monomer blocks selected from ethylene, propylene, butylene, butadiene, isoprene and styrene monomers and wherein the VI improving additive is used at a concentration of from 0.001% w/w to 0.05% w/w.

It has surprisingly been found that the use of a linear block copolymer as defined herein in a diesel fuel composition can provide improved fuel economy benefits in an engine, even when used at low concentrations.

BRIEF DESCRIPTION OF THE DRAWINGS

The invention is further illustrated by the accompanying drawings in which.

DETAILED DESCRIPTION OF THE INVENTION

Figure 1:
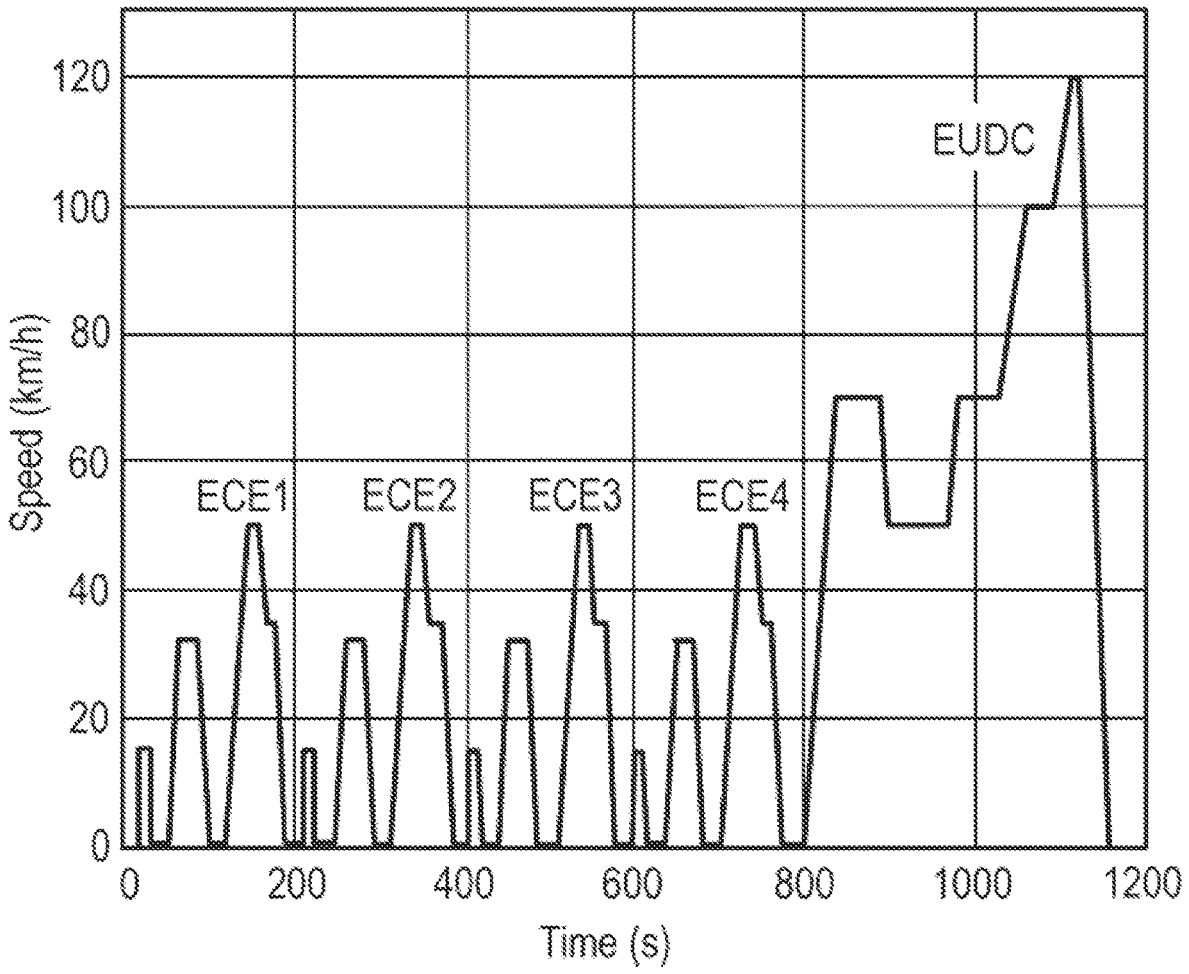
FIG. 1 illustrates the "New European Driving cycle" (NEDC), which includes four consecutive "city cycles" (ECE) and one extra-urban "overland cycle" (EUDC).

The engine is preferably a diesel or compression ignition engine. However, it is also envisaged that the invention may be applicable to gasoline fuel compositions and corresponding internal combustion engines of a non-compression ignition type. The diesel engine may also be a turbo-charged diesel engine. The engine may be under the control of an engine management system (EMS).

The viscosity increasing component may be added to the fuel composition at the refinery or outside the refinery, such as prior to delivery to the point of sale or at the point of sale.

The invention also relates to methods for improving/increasing the fuel economy of an engine or of a vehicle powered by such an engine. The method comprises introducing into a combustion chamber of the engine a fuel composition comprising a viscosity increasing component. A preferred fuel composition is a diesel fuel and a preferred engine is a compression ignition engine. It will be appreciated that all features and embodiments described in relation to the uses of the invention are applicable to the methods of the invention, unless otherwise stated.

In yet another aspect, the invention relates to a method of operating a compression ignition engine and/or a vehicle which is powered by such an engine. In this aspect, the method involves introducing into a combustion chamber of the engine a fuel composition comprising a viscosity increasing component as defined herein.

According to a specific application, the uses and/or methods of the invention may be for the purpose of reducing or mitigating a reduction in fuel economy that may, for example, be caused by the addition of a fuel component or additive that has been or is intended to be introduced into the fuel composition for any other purpose, e.g. for improving the emissions performance of the fuel concerned. Advantageously, the use of the invention causes a minimal deterioration, neutral or better emissions performance compared to that of the diesel fuel comprised in the fuel composition prior to addition of the viscosity increasing component. Likewise, the uses and/or methods of the invention suitably have minimal, or no detrimental impact on the performance of an engine powered by the fuel composition, compared to its performance prior to addition of the viscosity improving component.

In specific embodiments, the uses and methods of the invention may be for formulating fuels that give demonstrably improved fuel economy in a particular engine, whilst falling within a desirable or predetermined fuel standard, for example, the fuel composition may be a diesel fuel corresponding to the European Standard EN 590 (2000), for example an "ultra low sulphur diesel". Alternatively, the uses and methods may be for ameliorating fuel economy losses that are associated with fuels or fuel blends which have a low volumetric energy, for example to give lower vehicle emissions, such as in a fuel or fuel blend containing a diesel fuel corresponding to the Swedish Class 1 standard.

In yet another aspect of the invention there is provided a method for the preparation of a fuel composition conferring greater fuel economy on an engine, and especially a diesel fuel composition for use in a compression ignition engine. The method comprising adding a viscosity increasing component, such as defined herein, to the fuel composition; and blending the viscosity increasing component with the fuel composition to provide a fuel composition suitable for providing better fuel economy in a selected engine.

In order to assist with the understanding of the invention several terms are defined herein.

"Viscosity Index" (or VI) is an arbitrary unit used to measure the change of kinematic viscosity with temperature. It is generally used to characterise lubricating oils in the automotive industry. Thus, the Viscosity Index highlights how a liquid's (or lubricant's) viscosity changes with variations in temperature. In general, the viscosity of a liquid decreases as its temperature increases. Many lubricant or fuel applications require the liquid to perform across a wide range of engine conditions: for example, at start-up when the liquid is at prevailing temperature of the environment, as well as when it is running (up to 200° C./392° F.). The higher the VI, the smaller the relative change in viscosity with temperature. Desirably, a fuel composition will not vary much in viscosity over its typical operating temperature range (i.e. it will have a relatively high VI).

The reference temperatures at which viscosity is measured in accordance with the VI scale were chosen arbitrarily to be 37.8° C. and 98.9° C. (i.e. 100° F. and 210° F.). Typically, however, kinematic viscosity measurements are taken at approximately 40° C. and/or approximately 100° C., unless otherwise indicated. Conveniently, kinematic viscosity is measured using standardised testing procedures known to the person of skill in the art, such as ASTM D-445 or EN ISO 3104.

The term "viscosity increasing component" as used herein, encompasses any component that, when added to a fuel composition at a suitable concentration, has the effect of increasing the viscosity of the fuel composition relative to its previous viscosity at one or more temperatures within the operating temperature range of the fuel.

VI improvers (also known as viscosity modifiers) are additives that increase the viscosity of the fluid throughout the useful temperature range of the VI improver. The useful operating temperature preferably overlaps at least a portion of the operating temperature range of a fuel composition in an engine.

VI improvers are polymeric molecules that are sensitive to temperature. At low temperatures, the molecule chains contract and so do not significantly impact on the fluid viscosity. However, at high temperatures, the chains relax and a relative increase in viscosity occurs; although the actual viscosity will still decrease as temperature increases. Hence, the addition of VI improvers serves to slow down rather than halt the rate at which the viscosity decreases.

There are many types and structures of VI improvers. Higher molecular weight polymers make better thickeners but tend to have less resistance to mechanical shear. On the other hand, lower molecular weight polymers are more shear-resistant, but do not improve viscosity as effectively at higher temperatures and, therefore, may be used in larger quantities to achieve the same effect at a desired temperature.

As used herein, an "increase" in the context of fuel viscosity embraces any degree of increase compared to a previously measured viscosity under the same or equivalent conditions. Thus, the increase is suitably compared to the viscosity of the fuel composition prior to incorporation of the viscosity increasing (or improving) component or additive. Alternatively, the viscosity increase may be measured in comparison to an otherwise analogous fuel composition (or batch of the same fuel composition); for example, which is intended (e.g. marketed) for use in an internal combustion engine, in particular a diesel engine, prior to adding a viscosity increasing component to it.

The present invention may, for example, involve adjusting (i.e. increasing) the viscosity of the fuel composition, using the viscosity increasing component in order to achieve a desired target viscosity.

As noted, the viscosity increasing component is used in a sufficient quantity to increase the viscosity of the fuel composition to which it is added as measured under the same conditions. The increase in kinematic viscosity may be measured at any suitable temperature, such as at 40° C. or at 100° C. Conveniently, viscosity is measured at 40° C. Suitably, the viscosity increasing component is used in an amount to increase the viscosity by at least 0.05 $mm^2/s$, at least 0.1 $mm^2/s$, or at least 0.2 $mm^2/s$. More suitably, the viscosity increase may be between 0.25 $mm^2/s$ and 2.0 $mm^2/s$; or between 0.25 $mm^2/s$ and 1.0 $mm^2/s$. In a preferred embodiment the viscosity increase is between 0.3 $mm^2/s$ and 0.8 $mm^2/s$, such as between 0.32 $mm^2/s$ and 0.67 $mm^2/s$. In some cases it may be desirable to increase the viscosity by approximately 0.4 $mm^2/s$, approximately 0.5 $mm^2/s$, approximately 0.6 $mm^2/s$ or approximately 0.7 $mm^2/s$.

Likewise, an "increase" in the context of fuel economy encompasses any amount of increase compared to the fuel economy of the same fuel composition prior to addition of the viscosity increasing component, as measured in the same or equivalent engine. Alternatively, the increase in fuel economy may be measured relative to an analogous fuel composition under the same or equivalent conditions in the same or equivalent engine. Thus, the increase is suitably compared to the fuel economy of an engine or vehicle prior to incorporation of the viscosity increasing (or improving) component or additive.

The increase in fuel economy may be measured and/or reported in any suitable manner, such as a percentage increase, as an increase in distance travelled (e.g. km) for a set volume of fuel (e.g. L), or as a reduction in fuel volume or mass to travel a particular distance under the same conditions (e.g. speed, workload). By way of example, the percentage increase may be at least 0.1%, such as at least 0.2%. Suitably, the percentage increase in fuel economy is at least 0.25%, or at least 0.5%. More suitably, the increase in fuel economy is at least 1.0%, at least 2.0% or at least 3.0%. In some particularly preferred embodiments, the increase in fuel economy is at least 5.0% or even at least 10%. However, it should be appreciated that any measurable improvement in fuel economy may provide a worthwhile advantage, particularly when it is considered how much fuel is used by vehicles throughout the world on a daily basis.

The engine in which the fuel composition of the invention is used may be any appropriate engine. Thus, where the fuel is a diesel or biodiesel fuel composition, the engine is a diesel or compression ignition engine. Likewise, any type of diesel engine may be used, such as a turbo charged diesel engine, provided the same or equivalent engine is used to measure fuel economy with and without the viscosity increasing component. Similarly, the invention is applicable to an engine in any vehicle. Generally, the invention is also applicable to any driving conditions, such as urban, extra urban and/or motorway/freeway/test track driving conditions; although the invention may be particularly beneficial in certain engine type and/or under specific driving conditions.

In the context of the present invention, "use" of a viscosity increasing component in a fuel composition means incorporating the component into the composition, typically as a blend (i.e. a physical mixture) with one or more fuel components (typically diesel base fuels) and optionally with one or more fuel additives.

The viscosity increasing component is preferably incorporated into the fuel composition before the composition is introduced into an engine which is to be run on the composition.

Accordingly, the viscosity increasing component may be dosed directly into (e.g. blended with) one or more components of the fuel composition or the base fuel at the refinery. For instance, it may be pre-diluted in a suitable fuel component, which subsequently forms part of the overall automotive fuel composition.

Alternatively, it may be added to an automotive fuel composition downstream of the refinery. For example, it may be added as part of an additive package containing one or more other fuel additives. This can be particularly advantageous because in some circumstances it can be inconvenient or undesirable to modify the fuel composition at the refinery. For example, the blending of base fuel components may not be feasible at all locations, whereas the introduction of fuel additives, at relatively low concentrations, can more readily be achieved at fuel depots or at other filling points such as road tanker, barge or train filling points, dispensers, customer tanks and vehicles.

Accordingly, the "use" of the invention may also encompass the supply of a viscosity increasing component together with instructions for its use in an automotive fuel composition to achieve one of the benefits of the present invention (e.g. an increase in fuel economy in a particular internal combustion engine or in a particular vehicle). The viscosity increasing component may therefore be supplied as a component of a formulation which is suitable for and/or intended for use as a fuel additive, in particular a diesel fuel additive. By way of example, the viscosity increasing component or additive may be incorporated into an additive formulation or package along with one or more other fuel additives. The one or more fuel additives may be selected from any useful additive, such as detergents, anti-corrosion additives, esters, poly-alpha olefins, long chain organic acids, components containing amine or amide active centres, and mixtures thereof, as is known to the person of skill in the art.

Instead, or in addition, the "use" of the invention may involve running an engine on the fuel composition containing the viscosity increasing component, typically by introducing the fuel composition into a combustion chamber of the engine.

Viscosity Increasing Components

Viscosity increasing components for use herein are VI improving additives. VI improving additives tend to be synthetically prepared and are therefore typically available with a well-defined constitution and quality, in contrast to, for example, mineral derived viscosity increasing fuel components (refinery streams), the constitution of which can vary from batch to batch. VI improving additives are also widely available, for use in lubricants, which can again make them an attractive additive for the new use proposed by the present invention. They are also often less expensive, in particular in view of the lower concentrations needed, than other viscosity increasing components such as mineral base oils.

The VI improving additive used in a fuel composition in accordance with the present invention is polymeric in nature. The VI improving additive for use herein is a linear block copolymer, which contains one or more monomer blocks selected from ethylene, propylene, butylene, butadiene, isoprene and styrene monomers. A particularly preferred VI improver is a linear copolymer based on styrene and isoprene; and a specifically preferred VI improver is SV™ 160, a polystyrene-polyisoprene linear block copolymer, commercially available from Infineum.

The kinematic viscosity at 40° C. (VK 40, as measured by ASTM D-445 or EN ISO 3104) of the VI improving additive is suitably 40 $mm^2/s$ or greater, preferably 100 $mm^2/s$ or greater, more preferably 1000 $mm^2/s$ or greater. Its density at 15° C. (ASTM D-4052 or EN ISO 3675) is suitably 600 $kg/m^3$ or greater, preferably 800 $kg/m^3$ or greater. Its sulphur content (ASTM D-2622 or EN ISO 20846) is suitably 1000 mg/kg or lower, preferably 350 mg/kg or lower, more preferably 10 mg/kg or lower.

The VI improving additive may be pre-dissolved in a suitable solvent, for example an oil such as a mineral oil or Fischer-Tropsch derived hydrocarbon mixture; a fuel component (which again may be either mineral or Fischer-Tropsch derived) compatible with the fuel composition in which the additive is to be used (for example a middle distillate fuel component such as a gas oil or kerosene, when intended for use in a diesel fuel composition); a poly alpha olefin; a so-called biofuel such as a fatty acid alkyl ester (FAAB), a Fischer-Tropsch derived biomass-to-liquid synthesis product, a hydrogenated vegetable oil, a waste or algae oil or an alcohol such as ethanol; an aromatic solvent; any other hydrocarbon or organic solvent; or a mixture thereof. Preferred solvents for use in this context are mineral oil-based diesel fuel components and solvents, and Fischer-Tropsch derived components such as the "XtL" components referred to below. Biofuel solvents may also be preferred in certain cases.

The VI improving additive is used at a concentration in the range from 0.001 to 0.05% w/w, based on the total weight of the fuel composition. One of the advantages of the present invention is that the particular VI improving additive defined herein can provide improved fuel economy even when used at low concentrations.

In certain embodiments, the VI improving additive may be used at a concentration of:

(i) from 0.005% w/w to 0.03% w/w;

(ii) from 0.006% w/w to 0.025% w/w; or (iii) from 0.007% w/w to 0.02 w/w;

based on the total weight of the fuel composition.

The VI improving additive is preferably used at a concentration of:

(i) from 0.0075% w/w to 0.0175% w/w;

(ii) from 0.008% w/w to 0.015% w/w; or (iii) from 0.009% w/w to 0.013% w/w;

based on the total weight of the fuel composition.

In some embodiments the viscosity increasing component is used in an amount sufficient to increase the kinematic viscosity of the fuel composition by (i) at least 0.2 $mm^2/s$; (ii) 0.25 $mm^2/s$ to 1.0 $mm^2/s$; or (iii) 0.32 $mm^2/s$ to 0.67 $mm^2/s$; compared to the viscosity of the fuel composition prior to the addition of the viscosity increasing component. The kinematic viscosity is measured under standard conditions, such as at 40° C.

As will be appreciated, the resultant or desired final kinematic viscosity of the fuel composition may be determined according to the desired properties of the fuel and/or by national or International regulations and standards. By way of example, in one embodiment, the kinematic viscosity at 40° C. of the diesel fuel composition comprising the viscosity increasing component may be up to 4.5 $mm^2/s$; such as between 2.0 $mm^2/s$ and 4.0 $mm^2/s$; or between 3.0 $mm^2/s$ and 3.8 $mm^2/s$.

These concentrations are for the VI improving additive itself, and do not take account of any solvent(s) with which its active ingredient may be pre-diluted; and are based on the mass of the overall fuel composition. Where a combination of two or more VI improving additives is used in the composition, the same concentration ranges may apply to the overall combination of VI improving additives. It will be appreciated that amounts/concentrations may also be expressed as ppm, in which case 1% w/w corresponds to 10,000 ppm w/w.

In accordance with one embodiment of the present invention, two or more viscosity increasing components may be used in an automotive fuel composition to provide one or more of the effects of the invention described herein.

The remainder of the composition will typically consist of one or more automotive base fuels, for instance as described in more detail below, optionally together with one or more fuel additives. The concentration of the VI improving additive used may depend on desirable fuel characteristics/properties, such as: the desired viscosity of the overall fuel composition; the viscosity of the composition prior to incorporation of the additive; the viscosity of the additive itself; and/or the viscosity of any solvent in which the additive is used. The relative proportions of the VI improving additive, fuel component(s) and any other components or additives present in a diesel fuel composition prepared according to the invention may also depend on other desired properties such as density, emissions performance and cetane number.

Density of the overall fuel composition may in some cases be a particularly relevant parameter.

Emission levels may be measured using standard testing procedures such as the European R49, ESC, OICA or ETC (for heavy-duty engines) or ECE+EUDC or MVEG (for light-duty engines) test cycles. Ideally emissions performance is measured on a diesel engine built to comply with the Euro II standard emissions limits (1996) or with the Euro III (2000), IV (2005) or even V (2008) standard limits.

Uses and Methods

Viscosity index improving additives (also referred to as VI improvers) are well known for use in lubricant formulations, where they are used to maintain viscosity as constant as possible over a desired temperature range by relatively increasing viscosity (i.e. slowing the decrease in viscosity) at higher temperatures. They are typically based on relatively high molecular weight, long chain polymeric molecules that can form conglomerates and/or micelles. These molecular systems expand at higher temperatures, thus further restricting their movement relative to one another and in turn increasing the viscosity of the system. Known VI improvers are typically included in lubricating oil formulations at concentrations between 1 and 20% w/w. In WO 01/48120, however, certain of these types of additive are proposed for use in fuel compositions, in particular diesel fuel compositions, for the purpose of improving the ability of an engine to start at elevated temperatures. In US 2009/0241882, certain VI improving additives are described for use in fuel compositions for the purpose of improving acceleration performance, which can be manifested by an increase in engine power, and/or torque, and/or vehicle tractive effort at any given speed. WO2012/076653 discloses the use of a viscosity increasing component in a diesel fuel composition, for the purpose of improving the fuel economy of an engine into which the fuel composition is or is intended to be introduced. There are examples in this document disclosing the use of SV200 in a diesel fuel composition for improving fuel economy. SV200 is a polystyrene/polyisoprene stellate polymer. In the examples the SV200 is used at concentrations of 1000 ppm and 2000 ppm.

It has now been found that certain VI improving additives can significantly increase the viscosity of an automotive fuel composition, in particular a diesel fuel composition, even when used at relatively low concentrations; and that this can improve the fuel economy of an engine into which the composition is introduced. These fuel economy benefits may be observed under any type of driving condition, such as urban, extra urban, and highway, at low speed and/or at high speed. The invention is not, therefore, limited to specific driving conditions, although the fuel economy benefits may be more apparent under some particular conditions than others.

Likewise, the fuel economy benefits are not limited to particular types of engine, although diesel compression ignition engines are preferred. Furthermore, the advantages of the invention may apply in turbo charged engines as well as in non-turbo engines.

Thus, the present invention can provide an effective way of improving the fuel economy of an internal combustion engine by means of the fuel introduced into it.

While the amount of the viscosity increasing component for use in accordance with the invention may vary depending of fuel type and/or engine type; a benefit of the invention is that under some conditions the amount of VI improver needed to observe the benefit of the invention may be surprisingly low, such as at the level of typical fuel additives. This in turn can reduce the cost and complexity of the fuel preparation process. For example, it can allow a fuel composition to be altered, in order to improve fuel economy, by the incorporation of additives downstream of the refinery, rather than by altering the content of the base fuel at its point of initial preparation. The blending of base fuel components may not be feasible at all locations, whereas the introduction of fuel additives, at relatively low concentrations, can more readily be achieved at fuel depots or at other filling points such as road tanker, barge or train filling points, dispensers, customer tanks and vehicles.

Moreover, an additive which is to be used at a relatively low concentration can naturally be transported, stored and introduced into a fuel composition more cost effectively than can a fuel component which needs to be used at concentrations of the order of tens of percent by weight.

The use of relatively low concentrations of VI improving additives can also help to reduce any undesirable side effects: for example, impacting on distillation or cold flow properties, caused by their incorporation into a fuel composition.

Another aspect of the invention provides a method of operating an internal combustion engine and/or a vehicle powered by such an engine, which comprises introducing into a combustion chamber of the engine a fuel composition prepared in accordance with the invention. The fuel composition is preferably introduced for one or more of the purposes described in connection with this invention. Thus, the engine is preferably operated with the fuel composition for the purpose of improving its fuel economy. The engine is in particular a diesel engine and may be a turbo charged diesel engine. The diesel engine may be of the direct injection type, for example of the rotary pump, in-line pump, unit pump, electronic unit injector or common rail type, or of the indirect injection type. It may be a heavy or a light duty diesel engine. For example, it may be a common rail direct injection engine.

Diesel Fuel Compositions

Due to the inclusion of the VI improving additive, a fuel composition prepared according to the present invention (in particular a diesel fuel composition) will suitably have a VK 40 of 2.0 $mm^2/s$ or greater, 2.5 $mm^2/s$ or greater, 2.7 $mm^2/s$ or greater, 2.8 $mm^2/s$ or greater, or preferably 2.9 $mm^2/s$ or greater. In some cases the VK 40 may be up to 4.5 $mm^2/s$, up to 4.2 $mm^2/s$, or up to 4.0 $mm^2/s$. Advantageously, the VK 40 of the fuel composition including the viscosity increasing component (VI improver or otherwise) is in the range of 3.0 $mm^2/s$ to 4.0 $mm^2/s$, such as 3.0 $mm^2/s$ to 3.8 $mm^2/s$, 3.0 $mm^2/s$ to 3.6 $mm^2/s$, or 3.0 $mm^2/s$ to 3.3 $mm^2/s$. In exceptional cases, however, for example in arctic diesel fuels, the VK 40 of the composition may be as low as 1.5 $mm^2/s$, although it is preferably approximately 1.7 or 2.0 $mm^2/s$ or greater. It should be appreciated that references to viscosity herein are, unless otherwise specified, intended to mean kinematic viscosity.

The composition preferably has a relatively high density for a diesel fuel composition, such as 830 $kg/m^3$ or greater at 15° C. (ASTM D-4052 or EN ISO 3675), preferably 832 $kg/m^3$ or greater, such as from 832 to 845 $kg/m^3$ at 15° C., which is the upper limit of the current EN 590 diesel fuel specification. Preferably the composition herein has a density of 833 to 837 $kg/m^3$ at 15° C.

A diesel fuel composition prepared according to the present invention may in general be any type of diesel fuel composition suitable for use in a compression ignition (diesel) engine. It may contain, in addition to the VI improving additive, other standard diesel fuel components. It may, for example, include a major proportion of a diesel base fuel, for instance of the type described below. In this context, a "major proportion" means at least 50% w/w, and typically at least 85% w/w based on the overall composition. More suitably, at least 90% w/w or at least 95% w/w; and in some cases at least 98% w/w or at least 99% w/w of the fuel composition consists of the diesel base fuel.

Thus, in addition to the VI improving additive, a diesel fuel composition prepared according to the present invention may comprise one or more diesel fuel components of conventional type. Such components will typically comprise liquid hydrocarbon middle distillate fuel oil(s), for instance petroleum derived gas oils. In general, such fuel components may be organically or synthetically derived, and are suitably obtained by distillation of a desired range of fractions from a crude oil. Such gas oils may be processed in a hydride-sulphurisation (HDS) unit so as to reduce their sulphur content to a level suitable for inclusion in a diesel fuel composition. They will typically have boiling points within the usual diesel range of 150 to 410° C. or 170 to 370° C., depending on grade and use. In some cases, the fuel composition will include one or more cracked products obtained by splitting heavy hydrocarbons.

A diesel base fuel may consist of or comprise a Fischer-Tropsch derived diesel fuel component, typically a Fischer-Tropsch derived gas oil. As used herein, the term "Fischer-Tropsch derived" means that a material is, or is obtained from, a synthesis product of a Fischer-Tropsch condensation process. A Fischer-Tropsch derived fuel or fuel component will therefore be a hydrocarbon stream in which a substantial portion, except for added hydrogen, is derived directly or indirectly from a Fischer-Tropsch condensation process. The Fischer-Tropsch process converts carbon monoxide and hydrogen into longer chains, which are usually paraffinic hydrocarbons. The carbon monoxide and hydrogen may themselves be derived from organic, inorganic, natural or synthetic sources, such as from natural gas or from organically derived methane.

A Fischer-Tropsch derived diesel fuel component of use in the present invention may be obtained directly from the refining or the Fischer-Tropsch reaction, or indirectly for instance by fractionation or hydrotreating of the refining or synthesis product to give a fractionated or hydrotreated product. The desired fraction(s), typically gas oil fraction(s), may subsequently be isolated e.g. by distillation. Other post-synthesis treatments, such as polymerisation, alkylation, distillation, cracking-decarboxylation, isomerisation and hydroreforming, may also be employed to modify the properties of Fischer-Tropsch condensation products, as is known in the art.

Fischer-Tropsch fuels may be derived by converting gas, biomass or coal to liquid (XtL), specifically by gas to liquid conversion (GtL), or from biomass to liquid conversion (BtL). Any form of Fischer-Tropsch derived fuel component may be used as a base fuel in accordance with the invention.

Diesel fuel components contained in a composition prepared according to the present invention will typically have a density of from 750 to 900 kg/m$^3$, from 800 to 860 kg/m$^3$, at 15° C. (ASTM D-4052 or EN ISO 3675) and/or a VK 40 of from 1.5 to 6.0 mm$^2$/s (ASTM D-445 or BN ISO 3104).

In a diesel fuel composition prepared according to the present invention, the base fuel may itself comprise a mixture of two or more diesel fuel components of the types described above.

In beneficial embodiments of the invention, the diesel fuel may consist of or comprise a so-called "biodiesel" fuel component such as a vegetable oil, hydrogenated vegetable oil or vegetable oil derivative (e.g. a fatty acid ester, in particular a fatty acid methyl ester, FAME), or another oxygenate such as an acid, ketone or ester. Such components need not necessarily be bio-derived.

Where the fuel composition contains a biodiesel component, the biodiesel component may be present in quantities of between 1% and 99% w/w, for example. In one embodiment the fuel comprises at least 2% w/w biodiesel, such as between 2% and 80% w/w. In some cases, the biodiesel is present at between 2% and 50% w/w, such as between 3% and 40% w/w, between 4% and 30% w/w, or between 5% and 20% w/w. In one beneficial embodiment the biodiesel component is FAME. In a preferred application FAME is present at approximately 5% w/w based on the total weight of the fuel composition.

In accordance with the present invention, a viscosity increasing component, such as a VI improver may be used to increase the viscosity of a fuel composition. Thus, the base fuel(s) may have a relatively low viscosity (e.g. less than 3.3 mm$^2$/s) and may then be "improved" by incorporation of the viscosity increasing component. A base fuel component which is perhaps not intrinsically beneficial for good engine fuel economy, e.g. because refining processes or additives have been used to optimise another important property of the fuel (such as exhaust gas emissions), may thus be modified so as to improve fuel economy. Any detrimental effect that the additive or refining process might have been expected to have on fuel economy may be at least partially counteracted by increasing the viscosity of the fuel. Likewise, the relatively lower expected fuel economy level may be a result of the operating conditions of the engine or vehicle concerned, for example, as may be controlled by an engine management system. Accordingly, the uses and methods of the invention may also go some way towards counteracting lower engine fuel economy resulting, at least in part, from engine operating conditions/parameters.

In the case of a diesel fuel composition, for example, the base fuel(s) consist of or comprise relatively low viscosity components such as Fischer-Tropsch or mineral derived kerosene components, Fischer-Tropsch or mineral derived naphtha components, so-called "winter GtL" Fischer-Tropsch derived gas oils, low viscosity mineral oil diesel components or biodiesel components. Such base fuels may in some cases have a VK 40 (ASTM D-445 or EN ISO 3104) that is below the maximum permitted by the European diesel fuel specification EN 590, for instance below 4.5 mm$^2$/s, or below 3.5, 3.2 or 3.0 mm$^2$/s. In cases they may have a VK 40 below the minimum permitted by EN 590, for example below 2.0 mm$^2$/s or even below 1.5 mm$^2$/s. The VI improving additive may be pre-diluted in one or more such fuel components, prior to its incorporation into the final automotive fuel composition.

An automotive diesel fuel composition prepared according to the present invention will suitably comply with applicable current standard specification(s) such as, for example, EN 590 (for Europe) or ASTM D-975 (for the USA). By way of example, the overall fuel composition may have a density from 820 to 845 kg/m$^3$ at 15° C. (ASTM D-4052 or EN ISO 3675); a T95 boiling point (ASTM D-86 or EN ISO 3405) of 360° C. or less; a measured cetane number (ASTM D-613) of 51 or greater; a VK 40 (ASTM D-445 or EN ISO 3104) from 2 to 4.5 mm$^2$/s; a sulphur content (ASTM D-2622 or EN ISO 20846) of 50 mg/kg or less; and/or a polycyclic aromatic hydrocarbons (PAH) content (IP 391 (mod)) of less than 11% w/w. Relevant specifications may, however, differ from country to country and from year to year, and may depend on the intended use of the fuel composition.

It will be appreciated, however, that diesel fuel composition prepared according to the present invention may contain fuel components with properties outside of these ranges, since the properties of an overall blend may differ, often significantly, from those of its individual constituents.

A diesel fuel composition prepared according to the present invention suitably contains no more than 5000 ppmw (parts per million by weight) of sulphur, typically from 2000 to 5000 ppmw, or from 1000 to 2000 ppmw, or alternatively up to 1000 ppmw. The composition may, for example, be a low or ultra low sulphur fuel, or a sulphur free fuel, for instance containing at most 500 ppmw, beneficially no more than 350 ppmw, suitably no more than 100 or 50, or even 10 ppmw of sulphur.

An automotive fuel composition prepared according to the present invention, or a base fuel used in such a composition may contain one or more fuel additives or may be additive-free. If additives are included (e.g. added to the fuel at the refinery), it may contain minor amounts of one or more additives. Selected examples or suitable additives include (but are not limited to): anti-static agents; pipeline drag reducers; flow improvers (e.g. ethylene/vinyl acetate copolymers or acrylate/maleic anhydride copolymers); lubricity enhancing additives (e.g. ester- and acid-based additives); dehazers (e.g. alkoxylated phenol formaldehyde polymers); anti-foaming agents (e.g. polyether-modified polysiloxanes); ignition improvers/cetane improvers (e.g. 2-ethylhexyl nitrate (EHN), cyclohexyl nitrate, di-tert-butyl peroxide); anti-rust agents (e.g. a propane-1,2-diol semi-ester of tetrapropenyl succinic acid, or polyhydric alcohol esters of a succinic acid derivative); corrosion inhibitors; reodorants; anti-wear additives; antioxidants (e.g. phenolics such as 2,6-di-tert-butylphenol); metal deactivators; combustion improvers; static dissipator additives; cold flow improvers (e.g. glycerol monooleate, di-isodecyl adipate); antioxidants; and wax anti-settling agents. The composition may for example contain a detergent. Detergent-containing diesel fuel additives are known and commercially available. Such additives may be added to diesel fuels at levels intended to reduce, remove or slow the build up of engine deposits. In some embodiments, it may be advantageous for the fuel composition to contain an anti-foaming agent, more preferably in combination with an anti-rust agent and/or a corrosion inhibitor and/or a lubricity enhancing additive.

Where the composition contains such additives (other than the viscosity increasing components of the invention), it suitably contains a minor proportion (such as 1% w/w or less, 0.5% w/w or less, 0.2% w/w or less), of the one or more fuel additives, in addition to the viscosity increasing component(s). Unless otherwise stated, the (active matter) concentration of each such additive component in the fuel composition may be up to 10000 ppmw, such as in the range of 0.1 to 1000 ppmw; and advantageously from 0.1 to 300 ppmw, such as from 0.1 to 150 ppmw.

If desired, one or more additive components, such as those listed above, may be co-mixed (e.g. together with suitable diluent) in an additive concentrate, and the additive concentrate may then be dispersed into a base fuel or fuel composition. The viscosity increasing component, particularly the VI improver may, in accordance with the present invention, be incorporated into such an additive formulation. Such a fuel additive mixture typically contains a detergent, optionally together with other components as described above, and a diesel fuel-compatible diluent, which may be a mineral oil, a solvent such as those sold by Shell companies under the trade mark "SHELLSOL", a polar solvent such as an ester and, in particular, an alcohol (e.g. hexanol, 2-ethylhexanol, decanol, isotridecanol and alcohol mixtures such as those sold by Shell companies under the trade mark "LINEVOL", especially LINEVOL 79 alcohol which is a mixture of $C_{7-9}$ primary alcohols, or a $C_{12-14}$ alcohol mixture which is commercially available).

The total content of the additives in the fuel composition may be suitably between 0 and 10000 ppmw and more suitably below 5000 ppmw.

As used herein, amounts (e.g. concentrations, ppmw and % w/w) of components are of active matter, i.e. exclusive of volatile solvents/diluent materials.

In one embodiment, the present invention involves adjusting the viscosity of the fuel composition, using the viscosity increasing component (e.g. a VI improving additive), in order to achieve a desired target viscosity.

Suitably, the viscosity increasing component or VI improver increases the viscosity of the fuel composition by at least 0.005 $mm^2/s$ and less than 2.0 $mm^2/s$, as previously noted. More suitably, the viscosity increase is between 0.01 $mm^2/s$ and 1.0 $mm^2/s$, such as between 0.01 $mm^2/s$ and 0.5 $mm^2/s$.

The maximum viscosity of an automotive fuel composition may often be limited by relevant legal and/or commercial specifications, such as the European diesel fuel specification EN 590 that stipulates a maximum VK 40 of 4.5 $mm^2/s$, whilst a Swedish Class 1 diesel fuel must have a VK 40 of no greater than 4.0 $mm^2/s$. Typical commercial automotive diesel fuels are currently manufactured to far lower viscosities than these, however, such as around 2 to 3 $mm^2/s$. Thus, the present invention may involve manipulation of an otherwise standard specification automotive fuel composition, using a VI improving additive, to increase its viscosity so as to improve the fuel economy of an engine into which it is, or is intended to be, introduced, while remaining within desired or legal viscosity ranges.

In some preferred embodiments, the density of the fuel composition is affected by less than 1%, such as less than 0.1% by addition of the viscosity increasing component, for example, as measured using the standard test method ASTM D-4052 or EN ISO 3675.

According to another aspect of the invention, there is provided a process for the preparation of an automotive fuel composition, which process involves blending an automotive base fuel with a viscosity increasing component. The blending may be carried out for one or more of the purposes described herein.

Throughout the description and claims of this specification, the singular encompasses the plural unless the context otherwise requires. In particular, where the indefinite article is used, the specification is to be understood as contemplating plurality as well as singularity, unless the context requires otherwise.

Thus features, integers, characteristics, compounds, chemical moieties or groups described in conjunction with a particular aspect, embodiment or example of the present invention are to be understood to be applicable to any other aspect, embodiment or example described herein unless incompatible therewith. Thus, features of the "uses" of the invention are directly applicable to the "methods" of the invention. Moreover, unless stated otherwise, any feature disclosed herein may be replaced by an alternative feature serving the same or a similar purpose.

The invention will now be further illustrated by way of the following non-limiting examples.

EXAMPLES

Introduction

In these examples the results of a vehicle test program to evaluate the influence of fuel viscosity on diesel fuel economy is reported. A standard diesel was compared against the same diesel fuel containing different concentrations of a viscosity increasing component. As the viscosity increasing component, a VI improver, in particular, SV160 was used. SV160 is a linear polystyrene-polyisoprene block copolymer, commercially available from Infineum.

1. TEST PLATFORM AND TEST CYCLE

To assess the potential influence of fuel viscosity on diesel fuel economy a study was carried out using a Nissan Qashqai 1.5 dCi vehicle on a chassis dynamometer. Relevant technical information/data for the Nissan Qashqai vehicle used is shown in Table 1 below.

TABLE 1

| | |
|---|---|
| Vehicle | Nissan Qashqai 1.5 dCi |
| Cylinder | I4 |
| Displacement | 1461 cc |
| Power | 110 bhp |
| Compression | 15.2:1 |
| Emission standard | Euro 5 |
| Injection-system | Common rail direct injection |
| Exhaust | DOC and DPF |

Prior to the start of each test the chassis dynamometer was cooled to the prescribed temperature of the cold-start NEDC drive cycle.

Driving Cycle

As test cycle the non-transient New European Driving Cycle (NEDC) was selected (FIG. 1). The NEDC driving cycle consists of four repeated urban driving cycles (ECE) and an extra-urban driving cycle (EUDC), which accounts for higher speed driving modes. The NEDC is a widely recognised industry standard test cycle.

Fuel consumption was analysed by two methods: volumetric fuel flow and carbon mass balance.

For this program a single fuel economy test run consisted of 8 NEDCs over 4 days with forced cooling down to 22° C. between each cycle. Therefore, the NEDC cycles are not exact replications of the standard cold-start NEDC test, which has a minimum 6-hour soak period between tests and is cooled to approximately 23° C.

2. TEST FUELS AND TEST DESIGN

An overview of the test fuels used in the study is given in Table 2. A1 was the base fuel. Test fuel B1 was then obtained from base fuel A1 by adding VI improver SV160 at a concentration of 125 mg/kg.

TABLE 2

| Code | Description |
|---|---|
| A1 | CEC RF-06-08 |
| B1 | A1 + 125 mg/kg SV160 |

As described in section 1, the test results are the average fuel economy results over 4 cycles. In addition to the combined NEDC cycle results, there is separate fuel consumption data for (a) the cold start ECE
(b) ECE number 2, 3 and 4 combined; and
(c) EUDC cycle Table 3 shows the test sequence that was used for the assessment.

TABLE 3

| | Test 1 | Test 2 | Test 3 | Test 4 | Test 5 | Test 6 | Test 7 | Test 8 |
|---|---|---|---|---|---|---|---|---|
| Fuel code | A1 | B1 | B1 | A1 | A1 | B1 | A1 | B1 |
| SV160 (mg/kg) | 0 | 125 | 125 | 0 | 0 | 125 | 0 | 125 |

Further analytical details of selected fuels are provided in Table 4.

TABLE 4

| Fuel Code | A1 | B1 |
|---|---|---|
| Fuel Description | Base Fuel CEC RF-06-08 | Base Fuel CEC RF-06-08 + 125 ppm SV160 |
| Kinematic viscosity 40° C. ($mm^2/s$) (DIN ISO 3104) | 3.010 | 3.028 |

2.1 Test Results

Figure 2:
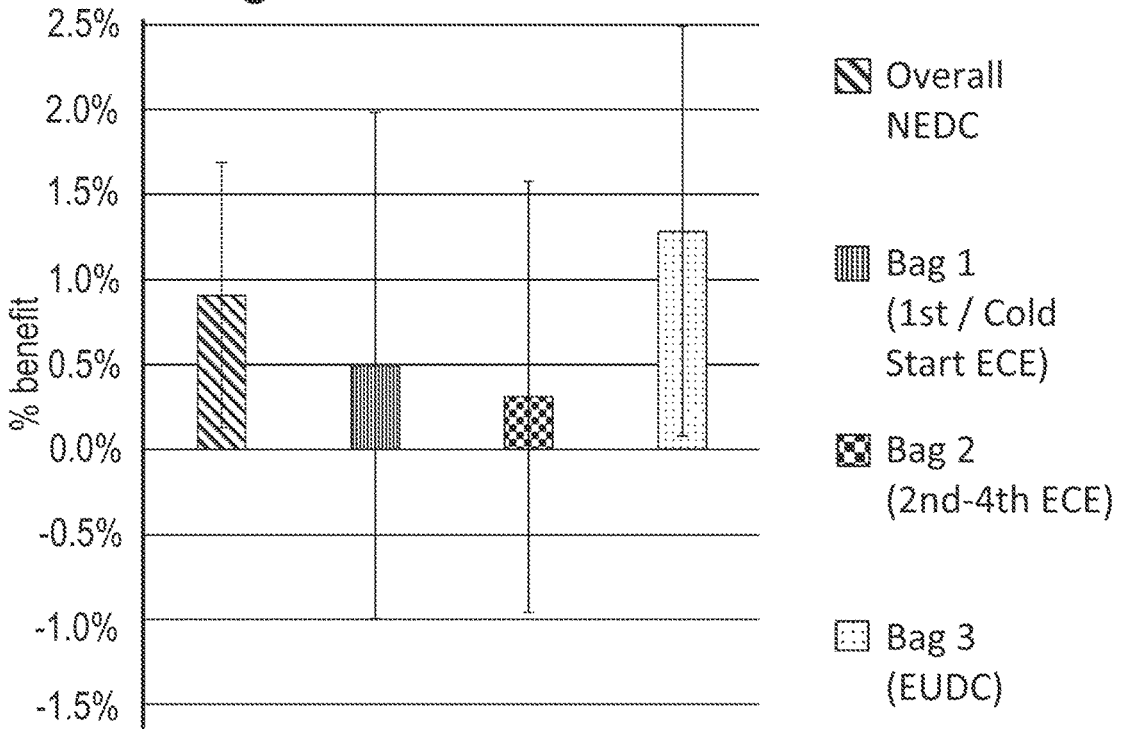
FIG. 2 shows the fuel consumption benefits brought about by SV160 at 125 mg/kg dosage, as measured by carbon mass balance. Benefits for the overall NEDC and EUDC shown in FIG. 2 were statistically significant with 90% confidence.
Figure 3:
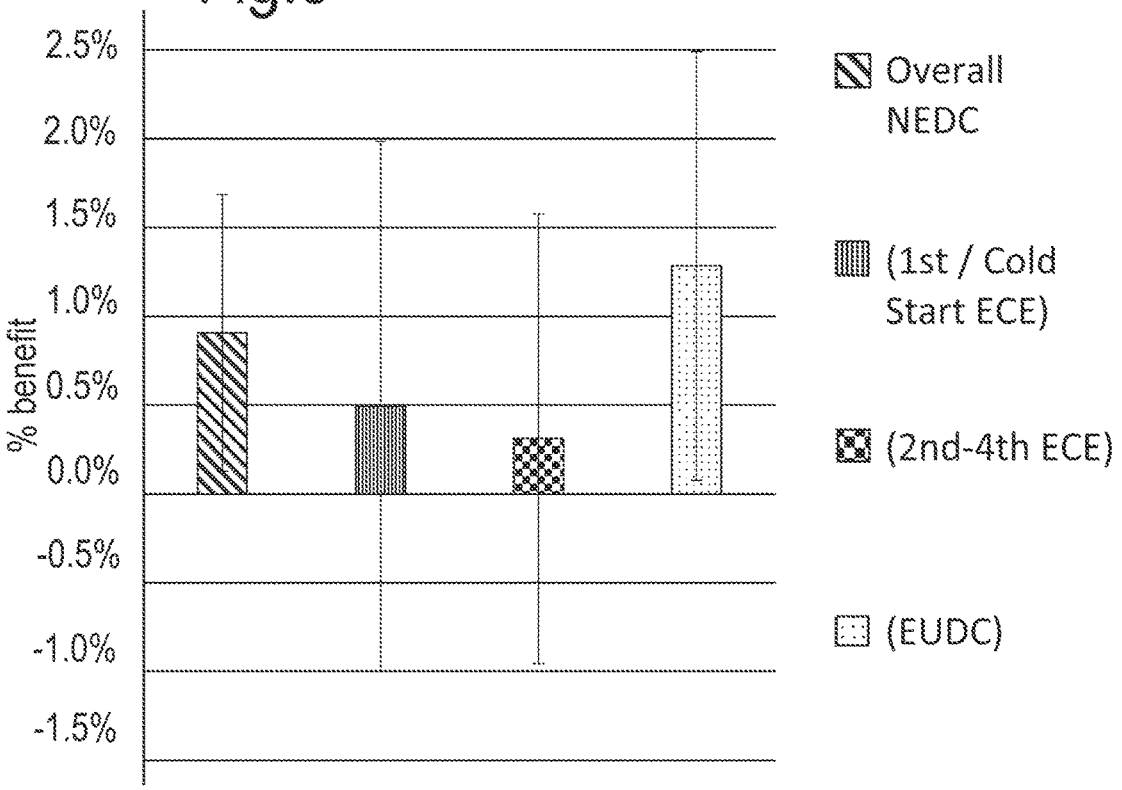
FIG. 3 shows the fuel consumption benefits brought about by SV160 at 125 mg/kg dosage, as measured by Coriolis meter. Benefits for the overall NEDC and EUDC shown in FIG. 3 were statistically significant with 90% confidence.

The measurements for the combined NEDC test are plotted in FIGS. 2 and 3. There were no issues with data quality and all test results were used in the statistical analysis. These data illustrate that the engine using the test fuel of the invention containing SV160 at 125 ppm, exhibited improved fuel economy in comparison to its performance when run on an otherwise identical control fuel lacking SV160.

Table 5 and FIG. 2 show the fuel consumption benefits brought about by SV160 at 125 mg/kg dosage, as measured by carbon mass balance. Benefits for the overall NEDC and EUDC shown in Table 5 and FIG. 2 were statistically significant with 90% confidence.

Table 6 and FIG. 3 show the fuel consumption benefits brought about by SV160 at 125 mg/kg dosage, as measured by Coriolis meter. Benefits for the overall NEDC and EUDC shown in Table 6 and FIG. 3 were statistically significant with 90% confidence.

TABLE 5

| | Overall NEDC | Bag 1 ($1^{st}$/Cold Start ECE) | Bag 2 ($2^{nd}$-$4^{th}$ ECE) | Bag 3 (EUDC) |
|---|---|---|---|---|
| Fuel B1 | 0.9% | 0.5% | 0.3% | 1.3% |

TABLE 6

| | Overall NEDC | $1^{st}$/Cold Start ECE | $2^{nd}$-$4^{th}$ ECE | EUDC |
|---|---|---|---|---|
| Fuel B1 | 0.9% | 0.5% | 0.3% | 1.3% |

3. CONCLUSIONS

The objective of this study was to evaluate the influence of fuel viscosity on diesel fuel economy in the Nissan Qashqai.

As illustrated in Tables 5 and 6 above, and FIGS. 2 and 3, at a concentration of 125 mg/kg of SV160 additive, an (average over all test results) fuel economy benefit compared to the control fuel of 0.9% was observed over the NEDC cycle; (with a statistical significance of 90%). Also, as indicated, in some cycles the fuel economy benefit in the test was 1.3% compared with a control fuel lacking the viscosity increasing component. Notably, the fuel economy benefit was consistently positive in all phases.

I claim:

1. A method for improving the fuel economy of an engine or of a vehicle powered by such an engine, comprising introducing into a combustion chamber of the engine a (diesel) fuel composition comprising a viscosity increasing component, wherein the viscosity increasing component is a viscosity index (VI) improving additive, wherein the VI improving additive comprises a polystyrene-polyisoprene linear block copolymer, wherein the viscosity increasing component is used in an amount sufficient to increase the kinematic viscosity of the diesel fuel composition at 40° C. by at least 0.005 $mm^2/s$ to about 0.018 $mm^2/s$, and wherein the percentage increase in fuel economy is at least 0.5% compared to the fuel economy of an engine or of a vehicle powered by such an engine fueled by an analogous fuel composition prior to incorporation of the viscosity increasing additive.

2. A method according to claim 1, wherein the VI improving additive is used at a concentration of from 0.007% w/w to 0.02% w/w, based on the total weight of the fuel composition.

3. A method according to claim 1, wherein the VI improving additive is used at a concentration of from 0.0075% w/w to 0.0175% w/w, based on the total weight of the fuel composition.

4. A method according to claim 1, wherein the VI improving additive is used at a concentration of from 0.008% w/w to 0.015% w/w, based on the total weight of the fuel composition.

5. A method according to claim 1, wherein the VI improving additive is used at a concentration of from 0.009% w/w to 0.013% w/w, based on the total weight of the fuel composition.

6. A method according to claim 1 wherein the kinematic viscosity at 40° C. of the diesel fuel composition comprising the viscosity increasing component is up to 4.5 $mm^2/s$.

7. A method according to claim 1 wherein the kinematic viscosity at 40° C. of the diesel fuel composition comprising the viscosity increasing component is in the range of from 2.0 $mm^2/s$ to 4.0 $mm^2/s$.

8. A method according to claim 1 wherein the kinematic viscosity at 40° C. of the diesel fuel composition comprising the viscosity increasing component is in the range of from 3.0 $mm^2/s$ and 3.8 $mm^2/s$.

9. A method according to claim 1 wherein the fuel composition comprises two or more viscosity increasing components.

10. A method according to claim 1 wherein the VI improving additive is linear polystyrene-polyisoprene block copolymer.

11. A method for improving the fuel economy of an engine or of a vehicle powered by such an engine, comprising introducing into a combustion chamber of the engine a (diesel) fuel composition comprising a viscosity increasing component, wherein the viscosity increasing component is a viscosity index (VI) improving additive, wherein the VI improving additive is linear polystyrene-polyisoprene block copolymer, wherein the viscosity increasing component is used in an amount sufficient to increase the kinematic viscosity of the diesel fuel composition at 40° C. by at least 0.005 $mm^2/s$, and wherein the percentage increase in fuel economy is at least 0.5% compared to the fuel economy of an engine or of a vehicle powered by such an engine fueled by an analogous fuel composition prior to incorporation of the viscosity increasing additive.

* * * * *